United States Patent [19]

Kircher et al.

[11] 3,932,261

[45] Jan. 13, 1976

[54] ELECTRODE ASSEMBLY FOR AN ELECTROLYTIC CELL

[75] Inventors: Morton S. Kircher, Oakville, Canada; Judson A. Wood, Cleveland, Tenn.

[73] Assignee: Olin Corporation, New Haven, Conn.

[22] Filed: June 24, 1974

[21] Appl. No.: 482,295

[52] U.S. Cl. ..... 204/288; 204/242; 204/252; 204/266; 204/278; 204/286

[51] Int. Cl.[2] ..... C25B 11/02

[58] Field of Search ..... 204/242, 252, 256, 266, 204/278, 286, 288

[56] References Cited

UNITED STATES PATENTS

| | | | |
|---|---|---|---|
| 2,987,463 | 6/1961 | Baker et al. | 204/266 |
| 3,342,717 | 9/1967 | Leduc | 204/252 X |
| 3,477,938 | 11/1969 | Kircher | 204/266 |
| 3,591,483 | 7/1971 | Loftfield et al. | 204/266 X |
| 3,632,497 | 1/1972 | Leduc | 204/266 X |
| 3,674,676 | 7/1972 | Fogelman | 204/252 |
| 3,803,016 | 4/1974 | Conner, Jr. | 204/266 X |

FOREIGN PATENTS OR APPLICATIONS

| | | | |
|---|---|---|---|
| 1,965,412 | 10/1970 | Germany | 204/266 |

*Primary Examiner*—T. Tung
*Assistant Examiner*—W. I. Solomon
*Attorney, Agent, or Firm*—James B. Haglind; D. F. Clements; T. P. O'Day

[57] ABSTRACT

An electrode is provided for use in electrolytic cells employing metal electrodes. The electrode comprises two electrode surfaces positioned in parallel and having a space between them: and at least two conductive supports one conductive support separately attached to each electrode surface and positioned in the space between the electrode surfaces. The conductive supports are also attached to and are substantially perpendicular to an electrode plate.

The electrode assembly is employed in electrolytic cells for producing chlorine and caustic soda or oxychlorine compounds by the electrolkysis of alkali metal chloride solutions.

11 Claims, 3 Drawing Figures

ELECTRODE ASSEMBLY FOR AN ELECTROLYTIC CELL

The invention relates to electrolytic cells for the electrolysis of aqueous salt solutions. More particularly this invention relates to electrode assemblies employed in electrolytic cells for the electrolysis of aqueous alkali metal chloride solutions.

Electrolytic cells have been extensively used in the preparation of chlorine and caustic or oxychlorine compounds such as chlorates by the electrolysis of brine in a number of different cell designs. One of the problems in all of these designs is to provide a satisfactory means for conducting current between the electrode wall or plate and the electrode surface.

The employment of metal electrodes as a replacement for graphite electrodes, particularly as the anode, has led to the development of electrodes, for example in diaphragm or chlorate cells, of increased size. The height of graphite anodes was limited to about 30 inches, by the electrical resistance of graphite and also by the maximum allowable gas void fraction in the inter-electrode gap. The use of highly conductive foraminous metal electrodes, however, permits employment of anodes having a height of at least 48 inches.

U.S. Pat. Nos. 3,591,483 and 3,707,454 issued to R. E. Loftfield et al., disclose anode assemblies for use with electrolytic cells where the cell bottom serves as the anode support and anode risers project upward from it and are attached to the anode surface.

An expandable electrode is disclosed in U.S. Pat. No. 3,674,676 where a riser, attached to the cell base, is commonly connected to two anode faces so that the distance between the anode faces can be adjusted while supplying current to the anode faces.

The above anode assemblies require they be used in cells having a horizontal base plate. In addition, they permit the unrestricted flow of fluids up thru the space between anode faces. They also require a riser having a sufficiently large diameter or cross section to supply current to the entire anode surface while providing adequate mechanical support. Such risers require high fabrication costs and permit high current losses due to high electrical resistance.

An improved electrode assembly is therefore required which can be used in cells where the electrodes are secured to the side of the cells which will effectively conduct current between the electrode surface and the electrode plate; which will provide adequate support for the electrode surface; and which will permit electrodes of increased height to be used while requiring as short a length of conductor as is necessary to carry the required electrical current. In addition, the electrode assembly will provide clear but restricted flow of fluids up thru the electrode.

It is an object of the present invention to provide a novel electrode assembly useful in electrolytic cells for the production of chlorine and oxychlorine compounds.

An additional object of this invention is to provide a novel electrode assembly useful in electrolytic cells employing metal anodes.

A further object of the present invention is to provide a novel electrode assembly useful in electrolytic cells in which the electrode paltes are positioned vertically.

Another object of the present invention is to provide a novel electrode permitting a continuous but restricted flow of fluids thru the space between electrode surfaces.

A still further object of the present invention is to provide a novel electrode assembly permitting adjustment of the spacing between electrodes.

An added object of the present invention is to provide an electrode permitting a partial contraction of the electrode during assembly in the cell.

These and other objects of the present invention are accomplished in an electrode assembly suitable for use in a cell for the electrolysis of an aqueous alkali metal chloride solution which comprises, two electrode surfaces positioned in parallel and having a space between the electrode surfaces, and at least two conductive supports, one conductive support separately attached to each of the electrode surfaces. The electrode assembly includes an electrode plate having openings for attachment of the conductive supports. The conductive supports are attached to the electrode plate so that they are perpendicular to the electrode plate.

Accompanying FIGS. 1–3 illustrate the novel electrode assembly of the present invention. Corresponding parts have the same numbers in all Figures.

Figure 1:
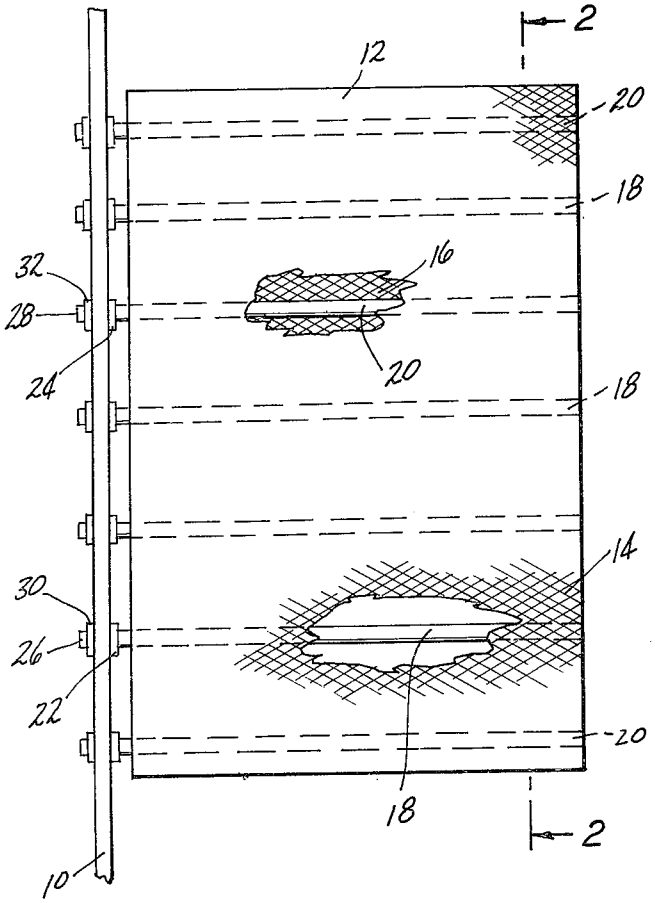
FIG. 1 illustrates a front elevation of the electrode assembly of the present invention with portions cut away.

The electrode assembly in FIG. 1 employs an electrode plate 10 having electrode 12 attached. Electrode 12 is composed of near electrode surface 14 having a plurality of conductive supports 18 attached, and far electrode surface 16 having a plurality of conductive supports 20 attached. Conductive supports 18 are spaced along electrode surface 14 and are alternately positioned with respect to conductive supports 20 which are also spaced along electrode surface 16. Conductive supports 18 have flanges 22 attached near threaded ends 26; and conductive supports 20 similarly have flanges 24 attached near threaded ends 28. Threaded ends 26 and 28 of conductive supports 18 and 20 respectively, pass through openings (not shown) in electrode plate 10 and are secured by nuts 30 and 32 respectively.

Figure 2:
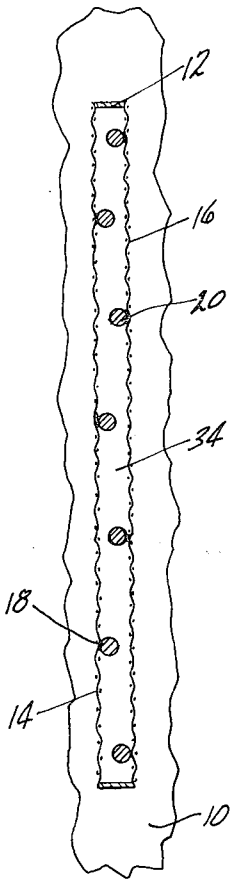
FIG. 2 shows a cross section taken along line 2—2 of FIG. 1.

In FIG. 2 electrode plate 10 has electrode 12 comprised of electrode surfaces 14 and 16 positioned in parallel and having space 34 between them. Conductive supports 18 are attached to electrode surfaces 14 within space 34. Similarly, conductive supports 20 are attached to electrode surface 16 within space 34.

Figure 3:
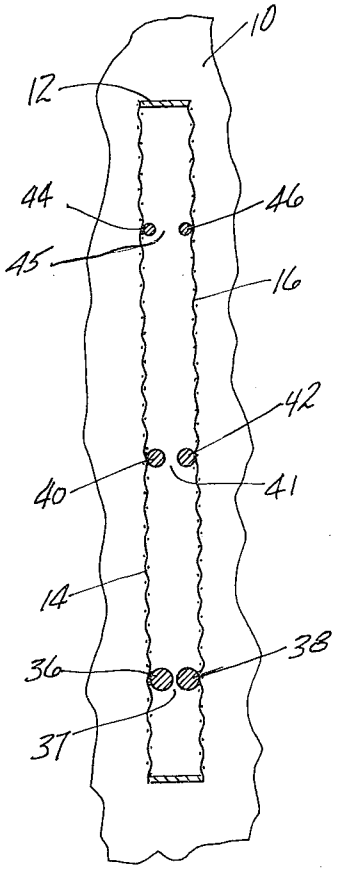
FIG. 3 illustrates an end view showing an alternate arrangement of the conductive supports.

In the electrode assembly of FIG. 3, electrode plate 10 has electrode 12 attached. Electrode 12 is comprised of electrode surfaces 14 and 16 positioned in parallel and having space 34 between them. Lower conductive supports 36 and 38, attached to electrode surfaces 14 and 16 respectively, are located in space 34 and have a sufficiently large diameter to restrict the flow of fluids up thru channel 37 between conductive supports 36 and 38. Intermediate conductive supports 40 and 42, also attached to electrode surfaces 14 and 16 respectively, have diameters smaller than lower conductive supports 36 and 38 yet restrict the flow of fluids up thru channel 41 separating conductive supports 36 and 37. Upper conductive supports 44 and 46, attached to electrode surfaces 14 and 16 respectively, have diameters smaller than intermediate conductive supports 40 and 42 and yet provide some restriction to the flow of fluids up thru channel 45.

The arrangement of conductive supports in FIG. 3 provides zones or compartments having varying concentrations of electrolyte and gases within intra electrode space 34 because of the difference in the width of the channels separating adjacent pairs of supports.

The electrode includes two electrode surfaces positioned in parallel and spaced apart. The intra electrode surface spacing can be any convenient distance, for example from about 0.5 to about 4, and preferably from about 0.75 to about 1.5 inches.

The conductive supports are attached to the electrode surfaces within the intra electrode surface spacing so that at least one support is separately attached to each electrode surface. The number of conductive supports employed is generally dependent on the size of the electrode surfaces. Where the length of the electrode surface is for example, about 48 inches, a plurality of conductive supports are separately attached to each electrode surface, for example, from 2 to about 8 and preferably from 3 to about 6. The conductive supports are preferably positioned substantially perpendicular to the largest dimension of the electrode surface-for example, the supports as shown in FIG. 1 are perpendicular to the vertical dimension of the electrode surface, where the electrode plate is vertical.

When the length of the electrode is greater, more conductive supports may be attached to each electrode surface if desired, if the length of the electrode is shorter, fewer conductive supports may be used.

The conductive supports may be attached to their respective electrode surfaces within the intra electrode space so that they are directly opposite to each other, are evenly alternated or unevenly alternated. Where alternated, the spacing between conductive supports on the same electrode surface is selected to provide optimum current distribution and mechanical support. In a preferred embodiment, the conductive supports are unevenly alternated.

Any convenient physical form of conductive support may be used such as rods, strips or bars. A preferred form of conductive support is a rod having a diameter of from about 0.25 to about 3 inches and preferably from about 0.5 to about 1.5 inches.

The electrode assembly of the present invention may be employed as an anode or a cathode, for example, in electrolytic cells suitable for the production of chlorine and caustic soda or oxychlorine compounds such as hypochlorites or chlorates.

It will be understood that, depending on whether the electrode assembly of the present invention serves as the anode or cathode, the materials of construction for the conductive support will be suitably selected to be resistant to the gases and liquids to which it is exposed. For example, when serving as an anode, the conductive support is suitably a conductive metal such as copper, silver, steel, magnesium or aluminum covered by a chlorine-resistant metal such as titanium or tantalum. Where the electrode assembly serves as the cathode, the conductive support is suitably, for example, steel, nickel, copper or coated conductive materials such as nickel coated copper.

While the two electrode surfaces may be separate and unconnected, in one embodiment, the electrode surfaces may be joined across the front or leading edge by attaching, for example, a section of the material employed as the electrode surfaces. The section may be attached by means such as soldering, welding, brazing or the like. If desired, the electrode surfaces may also be joined along the other edges. This is required where, for example, the electrode surfaces serve as a cathode in a diaphragm cell. The electrode surfaces are sealed along the edges and the electrode surfaces are also attached to the electrode plate to form a liquid impervious catholyte compartment. A diaphragm is attached or deposited on the electrode surfaces of the cathode and outlets are provided for the removal of gaseous and liquid products from the cathode compartment.

Where the electrode surfaces serve as the anode, while a non-metallic material such as graphite may be used, it is preferred to employ a valve metal such as titanium or tantalum or a metal, for example steel, copper or aluminum clad with a valve metal such as tantalum or titanium. The valve metal has a thin coating over at least part of its surface of a platinum group metal, platinum group metal oxide, an alloy of a platinum group metal or a mixture thereof. The term "platinum group metal" as used in the specification means an element of the group consisting of ruthenium, rhodium, palladium, osmium, iridium, and platinum.

The anode surfaces may be in various forms, for example, solid sheets, perforated plates, and in the case of metal as an expanded mesh which is flattened or unflattened, and having slits horizontally, vertically or angularly. Other suitable forms include woven wire cloth, which is flattened or unflattened, bars, wires, or strips arranged, for example, vertically, and sheets having perforations, slits or louvered openings.

A preferred anode surface is a foraminous metal mesh having good electrical conductivity in the vertical direction along the anode surface.

As the cathode, the electrode surface is suitably a metal screen or mesh where the metal is, for example, iron, steel, nickel, or tantalum. If desired, at least a portion of the cathode surface may be coated with a platinum group metal, oxide or alloy as defined above.

The electrode plates are suitably constructed of non-conductive materials, such as concrete or fiber-reinforced plastic or a conductive metal such as steel or copper. To avoid corrosive damage, the conductive metal may be covered with, for example, hard rubber or a plastic such as polytetrafluoroethylene or fiber-reinforced plastic. If desired, titanium may be used where the electrode plate serves as the anode plate.

Openings are provided in the electrode plate for attaching one end of the conductive supports. These openings may be holes of about the same size as the diameter or cross section of the conductive support. In a preferred embodiment, the openings permit lateral movement of the conductive supports to allow the spacing between the anode and the cathode to be varied. Slots, key holes, grooves and the like are suitable openings for permitting lateral movement of the conductive support. One end of the conductive support is attached to the electrode plate by any suitable means such as bolting.

When assembled in the electrolytic cell, the electrode plates may be positioned horizontally, vertically, or with one electrode plate, such as the anode plate, positioned horizontally and the other electrode plate positioned vertically. In a preferred embodiment, the electrode plates are positioned vertically.

Each electrode surface is attached to its conductive support, for example, by welding, soldering, brazing or the like.

In a preferred embodiment, the electrode assembly of the present invention is used as an anode in a diaphragm cell where the electrode plates are positioned vertically. The anode plate has a plurality of anodes attached and the cathode plate, which is vertically positioned and opposite the anode plate has a plurality of cathodes attached. The anodes and cathodes project horizontally across the cell and when the cell is assembled, an anode is inserted between two adjacent cathodes.

During assembly of a cell employing the electrode assemblies of the present invention, the intra electrode space may be reduced and the electrode contracted. This contraction is possible since the electrode surfaces are each separately attached to conductive supports. The largest amount of contraction is available when the conductive supports are arranged alternately, as shown in FIGS. 1 and 2, and foraminous metal electrode surfaces are used. The contraction permits for example, in a diaphragm cell, the insertion of the cathode between the anodes with a minimum of contact between the anode electrode surfaces and the diaphragm deposited on the cathode electrode surfaces. Once the cell is assembled, the electrode surfaces may be expanded to provide the desired anode-cathode spacing.

A plurality of electrodes are attached to the electrode plates, the exact number depending on the size of the electrode plate. For example, in an electrolytic cell employing the electrode assembly of the present invention, from about 2 to about 100 or more, or preferably from about 5 to about 50 electrodes are attached to the electrode plate.

The electrode assembly of the present invention may be employed in electrolytic cells for the electrolysis of aqueous salt solutions, for example, an alkali metal chloride such as sodium chloride or potassium chloride. Where a diaphragm or permselective cation-exchange membrane is employed, chlorine and an alkali metal hydroxide are produced. If the diaphragm or membrane is omitted, oxychlorine compounds such as alkali metal hypochlorites or alkali metal chlorates are obtained. Illustrative types of diaphragm cells include those of U.S. Pat. Nos. 1,862,244; 2,370,087; 2,987,463; 3,461,057; 3,617,461 and 3,642,604.

Particularly suitable are diaphragm cells in which the anodes and cathodes are mounted on opposite side walls of the cell, for example, in U.S. Pat. Nos. 3,247,090 or 3,477,938. Suitable examples of non-diaphragm cells include U.S. Pat. Nos. 3,700,582 and 3,732,153.

The following example is presented to illustrate the invention more fully. All parts and percentages are by weight unless otherwise indicated.

EXAMPLE

A diaphragm cell consisting of a sealed container having an anode assembly comprising an anode plate as the cell bottom and having two electrode surfaces positioned vertically and a vertical conductive support projecting up from the anode plate and attached to the electrode surfaces. The electrode surfaces were composed of two sheets of louvered titanium mesh, 48 inches high and 12 inches wide placed parallel to each other and spaced 1 inch apart. The outer face of each of the electrode surfaces was coated with a platinum metal oxide. A titanium clad copper rod 1 inch in diameter served as the conductive support and was bolted to the anode plate. The rod passed between and was welded to each electrode surface.

Three pairs of glass rods 0.75 inch in diameter, simulating conductive supports, were placed horizontally in the space between the anode surfaces at distances of 12, 24, and 36 inches from the bottom of the anode surfaces. All rods were attached along the back side of one anode surface. The rods provided for restricted but unobstructed flow of fluids up thru the intra electrode surface space.

Facing each electrode surface was a cathode assembly composed of a steel cathode plate vertically positioned and having a steel mesh electrode surface welded to the cathode plate. Each cathode screen was 48 inches high and 12 inches wide and was covered with an asbestos diaphragm 1/16 of an inch thick.

A copper bus bar was bolted to the bottom of the anode plate and a current lead-in attached to a power source supplied current to the cell.

The cell was provided with an inlet for sodium chloride brine and outlets for chlorine, hydrogen and caustic liquor. A space above the electrodes provided for an anolyte head and collecting $Cl_2$ gas. A space below the electrodes permitted brine feed to the electrodes. Four pipes having individual control valves connected the upper space with the lower space to permit controlled recycling of the anolyte solution. An aqueous solution containing 300 grams of sodium chloride per liter was introduced to the cell.

Three runs were made to show the effect of the horizontal rods on brine circulation and current efficiency while varying the amount of anolyte recirculation in the cell. The results are shown as runs 1–3 in Table I below.

For comparative purposes, three runs were repeated with the horizontal rods removed. These results are also shown as runs C1–3 in Table I below.

TABLE I

Effect of Horizontal Support Rods on Current Efficiency with Varying Amounts of Anolyte Recycle

| Run No. | Brine Temp. °C | Current Density KA/M² | Cell Voltage Volts | No. of Recycle Pipes Open | Ratio of NaCl to NaOH in Catholyte Liquor | Percent Current Efficiency (Based on NaOH) |
|---|---|---|---|---|---|---|
| RODS | | | | | | |
| 1 | 65 | 1.2 | 3.14 | 0 | 2.06 | 99.5 |
| 2 | 66 | 1.2 | 3.14 | 2 | 2.11 | 97.0 |
| 3 | 66 | 1.2 | 3.11 | 4 | 2.19 | 95.2 |
| NO RODS | | | | | | |
| C1 | 70 | 1.29 | 3.17 | 0 | 1.6 | 90.8 |
| C2 | 68 | 1.29 | 3.16 | 2 | 1.39 | 93.8 |
| C3 | 65 | 1.29 | 3.19 | 4 | 1.22 | 94.4 |

Table I above shows that current efficiency is increased when the horizontal rods are used to simulate conductive supports. Comparison of Example 1 and Example 2 with Examples C1 and C2 show current efficiencies of 99.5 and 97.0 percent versus current efficiencies of 90.8 and 93.8 respectively. These represent significant increases when anolyte recirculation is omitted or restricted. An increase in current efficiency also occurs when extensive anolyte recirculation is employed, as shown by comparing Example 3 with Example C3.

What is claimed is:

1. An electrode assembly suitable for use in a cell for the electrolysis of alkali metal chloride solution which comprises:

a. an electrode plate positioned vertically, b. two electrode surfaces positioned in parallel and having a space between said electrode surfaces, c. at least two conductive supports, one said conductive support separately attached to each of said electrode surfaces and positioned in said space between said electrode surfaces, and, d. openings in said electrode plate for attachment of said conductive supports, said conductive supports being attached substantially perpendicular to said electrode plate, said conductive supports adapted to conduct current between said electrode plate and said electrode surfaces, and said conductive supports adapted to permit continuous but restricted flow of said alkali metal chloride solution up through said space between said electrode surfaces.

2. The electrode assembly of claim 1 in which said conductive supports are positioned substantially perpendicular to the largest dimension of said electrode surface.

3. The electrode assembly of claim 1 in which a plurality of from about 2 to about 8 conductive supports are attached to each of said electrode surfaces.

4. The electrode assembly of claim 3 in which said conductive supports attached to each of said surfaces are positioned alternately with respect to each other.

5. The electrode assembly of claim 3 in which said conductive supports attached to each of said electrode surfaces are positioned opposite with respect to each other.

6. The electrode assembly of claim 5 in which said conductive supports have a channel between opposite pairs and have means for varying the width of said channel for adjacent pairs of said conductive supports.

7. The electrode assembly of claim 1 in which said openings in said electrode plate have means for permitting lateral movement of said conductive supports and said electrode assembly is an anode assembly.

8. The adjustable anode assembly of claim 7 in which a plurality of from about two to about eight conductive supports are attached to each of said electrode surfaces.

9. The adjustable anode assembly of claim 8 in which said conductive supports attached to said electrode surfaces are positioned alternately with respect to each other.

10. The adjustable anode assembly of claim 7 in which said conductive supports attached to each of said electrode surfaces are positioned in pairs opposite each other and having a channel between said conductive supports.

11. The adjustable anode assembly of claim 10 having means for varying the width of said channel for adjacent pairs of said conductive supports.

* * * * *